United States Patent [19]

Hofmann, Jr.

[11] 4,149,827

[45] Apr. 17, 1979

[54] METHOD AND APPARATUS FOR CONTROLLING OPERATION OF A COMPRESSOR

[76] Inventor: Rudolf Hofmann, Jr., c/o Sullair Europe Corp., Wallensteinstrasse 20, 8192 Geretsried, Fed. Rep. of Germany

[21] Appl. No.: 791,009

[22] Filed: Apr. 26, 1977

[30] Foreign Application Priority Data

Apr. 27, 1976 [DE] Fed. Rep. of Germany ..... 2618440

[51] Int. Cl.[2] ..... F04B 49/00

[52] U.S. Cl. ..... 417/12; 417/53; 417/290

[58] Field of Search ..... 417/12, 53, 18–24, 417/26–29, 295

[56] References Cited

U.S. PATENT DOCUMENTS

| | | | |
|---|---|---|---|
| 3,232,519 | 1/1966 | Long | 417/19 |
| 3,602,610 | 8/1971 | Bloom | 417/12 |
| 3,860,363 | 1/1975 | Silvern | 417/26 |
| 3,961,862 | 6/1976 | Edstrom | 417/295 |
| 4,052,135 | 10/1977 | Shoop | 417/295 |

*Primary Examiner*—William L. Freeh

*Attorney, Agent, or Firm*—Wegner, Stellman, McCord, Wiles & Wood

[57] ABSTRACT

A method in which automatic selection of the mode of operation for a compressor unit is achieved and is dependent on the conditions under which the compressor unit is operated. Depending on the existing compressed air demand and the time sequence thereof, the compressor unit operates in a continuous mode, an intermittent mode, or a regulated mode. During continuous mode operation, the compressor intake is either opened or closed so that the compressor unit operates respectively under zero load, when a minimum pressure condition exists, or full load, when a maximum pressure condition exists. During intermittent mode operation, the compressor unit is turned off when a maximum pressure condition exists and is turned on when a minimum pressure condition exists. During regulated mode operation, the compressor intake is varied between open and closed positions depending on output pressure. Appropriate compressor operation is achieved through the use of a control system including a timing and mode selection device, pressure switches, valves, and the like so that operation of the compressor unit is automatically regulated to reduce power requirements and compressor usage, while proper output pressure is maintained to fulfill compressed air demand.

26 Claims, 6 Drawing Figures

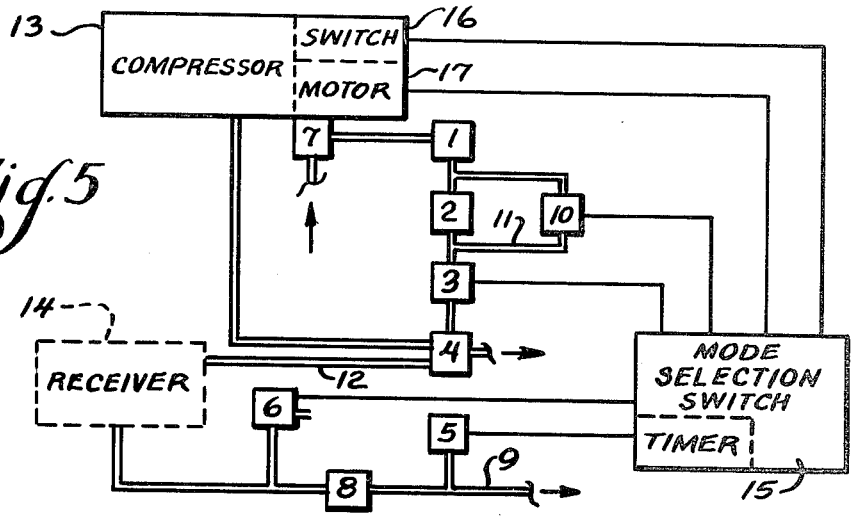
Fig. 5
Fig. 4b
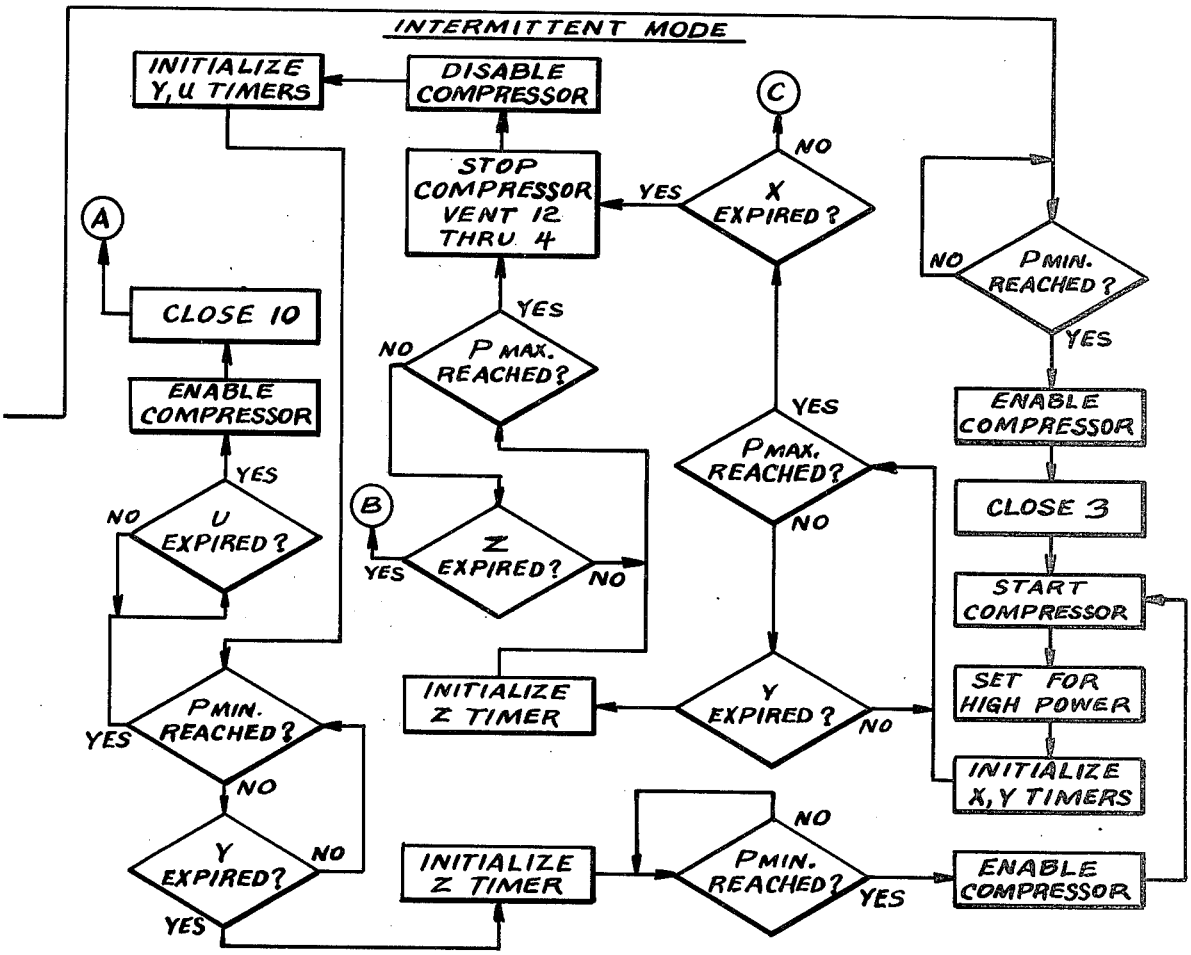

METHOD AND APPARATUS FOR CONTROLLING OPERATION OF A COMPRESSOR

This invention generally relates to a method for controlling the operation of a compressor unit and to an apparatus which carries out such a method.

In the prior art, either a continuous operating mode or a intermittent operating mode was selected for a compressor unit by means of a manually-operable selection switch. Thereafter, depending on the selected mode of operation, the turning on and off of the compressor unit or appropriate actuation of a throttle valve or flap was effected automatically as required. With this type of operating control, the optimum mode of compressor operation could only be achieved approximately. Typically, this mode selection scheme would be suitable only where compressor operation and use does not vary substantially over a period of time. In cases of frequently varying operating conditions or a cyclic operating mode, it would be disadvantageous to continuously repeat manual switching and, in some cases, such switching would not be feasible.

The object of the invention is to provide an improved method for controlling compressor operation which enables automatic switching so that a large number of compressor operating modes are attainable in a short span of time and at the same time ensure economical operation. In addition, it is an object to provide an apparatus for carrying out such a method.

In accordance with the invention, the compressor unit, in response to the pressure maintained by the compressor, is automatically operated in either (a) a continuous mode in which the compressor intake is opened and closed, or (b) an intermittent mode in which the drive motor of the compressor is turned on and off, or (c) a regulated mode in which compressor intake is substantially infinitely varied between open and closed positions to match actual existing compressed air demand.

The automatic selection of the optimum mode of operation under given conditions and the possibility of switching between three different modes of operation ensure economical operation under a large variety of different operating conditions. Further, this control system may be employed in situations where no compressed air receiver is available, i.e., where the compressor unit supplies compressed air directly to the consuming device. It is particularly suitable for movable or mobile compressor installations where such mode selection is of advantage.

The decision of what mode to operate under is made in response to the output pressure of the compressor system. In this connection, a multiple-stage pressure switch, or a plurality of differently set pressure switches measuring different successive pressure values, may be provided to obtain information for making a decision. In accordance with the invention, however, it is preferable that only a minimum value and maximum value of the pressure built up by the compressor be measured. These two pressure values are monitored within predetermined intervals of time, and an operating mode is selected depending on the pressure condition or pressure distribution within successive time intervals, whereby the existing mode of operation is maintained or another mode of operation selected.

According to an exemplary embodiment, a switching operation is caused to take place at a minimum pressure and at a maximum pressure, and each switching operation initiates a first time interval, which is followed by a second time interval. Continuous mode operation is either maintained or operation is switched over to continuous mode whenever a signal from the pressure switch corresponding to a minimum pressure condition is present during both time intervals. Operation is switched over to intermittent mode from continuous mode when a signal from the pressure switch corresponding to a maximum pressure condition is present during both time intervals. Intermittent mode operation is maintained until a switching operation occurs within the two time intervals. Operation of the compressor unit is switched over to regulated mode in response to one or more switching operations occurring within the first time interval. Regulated operation eliminates limitations in respect of the frequency of switching. However, due to the relatively high throttling losses associated with the regulated mode of operation, it is the least economical mode of operation. Consequently, regulated operation is only maintained for a predetermined period of time in order to obtain feedback to determine whether the regulated mode of operation is still advantageous for the installation under new given conditions. Finally, continuous mode operation is selected during starting of the compressor and after expiration of the time provided for regulated mode operation.

In order to advantageously reduce the expenditures of energy for generating compressed air during continuous mode operation, the compressor unit should be operated at reduced power whenever a maximum pressure condition is reached and the compressor intake is closed. This can be accomplished, in the case of a screw-type compressor, by reducing the speed and/or by reducing the pressure at discharge port of the compressor.

Energy requirements are further reduced if simultaneously with the initiation of the first time interval, a third time interval which is shorter than the first time interval, is also initiated so that the compressor unit is switched to regulated operating mode in response to one or more switching operations occurring within the third time interval. Introduction of the third time interval permits the time for ascertaining whether to operate in the regulated mode to be relatively short, while the first time interval can be selected to be relatively long in order to provide for sufficient time for deciding whether or not to turn off the compressor. A further reduction in energy can be achieved by turning off the compressor whenever a maximum pressure condition exists beyond the first time interval.

The third time interval which is provided for deciding whether or not to go to regulated mode operation may be initiated in response to each switching operation together with the first time interval. Preferably, however, the third time interval is initiated only in response to a minimum pressure condition being reached, since a quick reduction in the pressure from the maximum value would permit a better conclusion that continuous mode operation would be more advantageous in such an operating environment.

In the case of a screw-type compressor with oil injection, in order to avoid turning on the compressor immediately after it has been turned off, a fourth time interval is initiated together with the second time interval after expiration of the first time interval in the continuous mode of operation. During the fourth time interval, which is shorter than the second time interval, turning on of the compressor is prevented.

The apparatus used in carrying out the method includes a pressure switch disposed on the pressure side of the compressor unit. The pressure switch is arranged to switch at selectable minimum and maximum pressures and is connected to a timing device. The timing device is coupled to electronic circuitry for providing pulses, which, in turn, is connected to means for reducing the drive power of the compressor and to a switch for turning on and off the compressor and is further connected to means for adjusting the compressor intake. A check valve is disposed between the pressure switch and the compressor unit in the pressure line thereof.

Figure 4A:
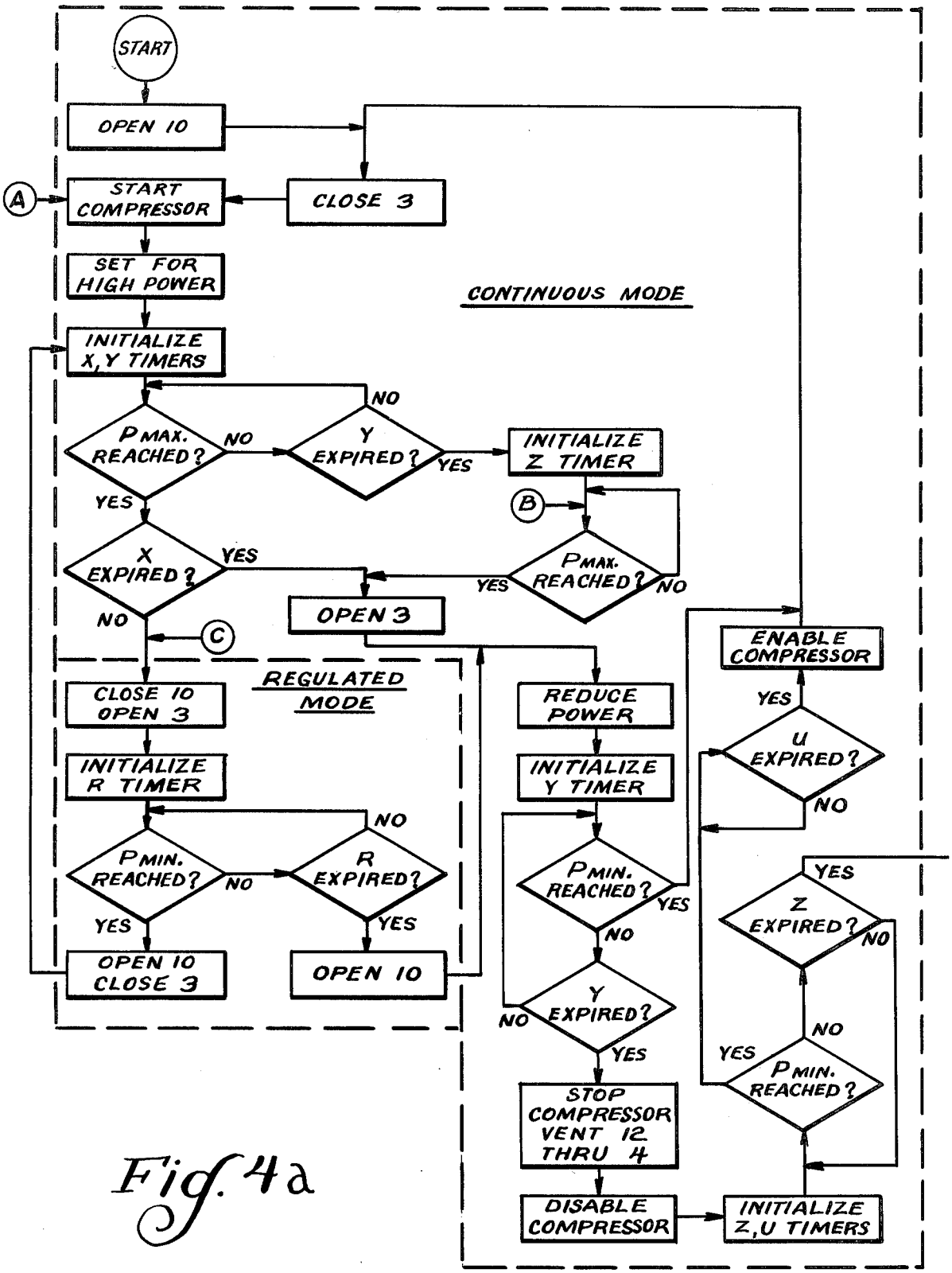

FIGS. 4*a* and 4*b* are a flow diagram illustrating the decision process in one method operating in accordance with the invention; and FIG. 5 is a schematic diagram of the control system.

Figure 1:
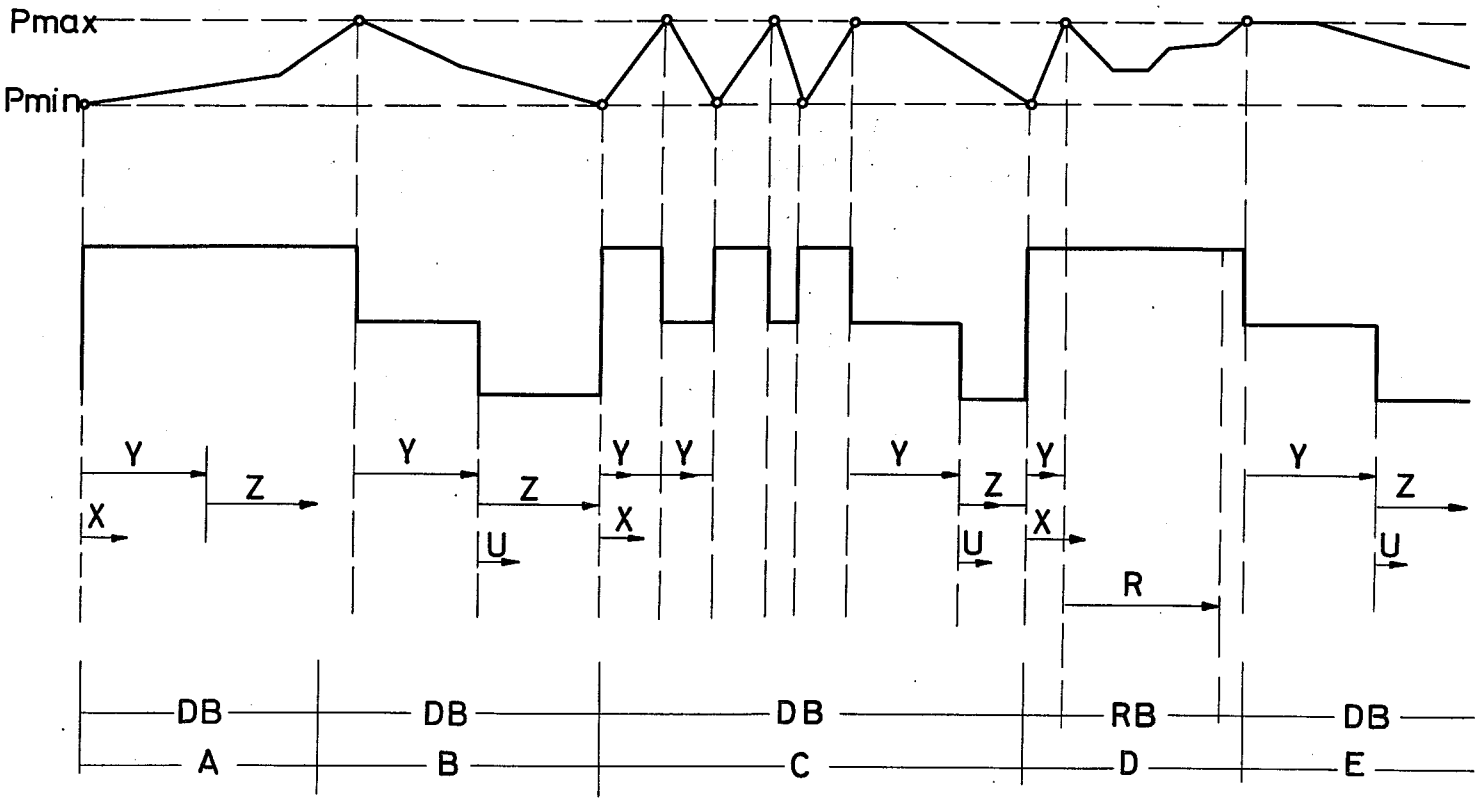
FIG. 1 is a graph which illustrates mode selection under different operating conditions and time sequences.
Figure 2:
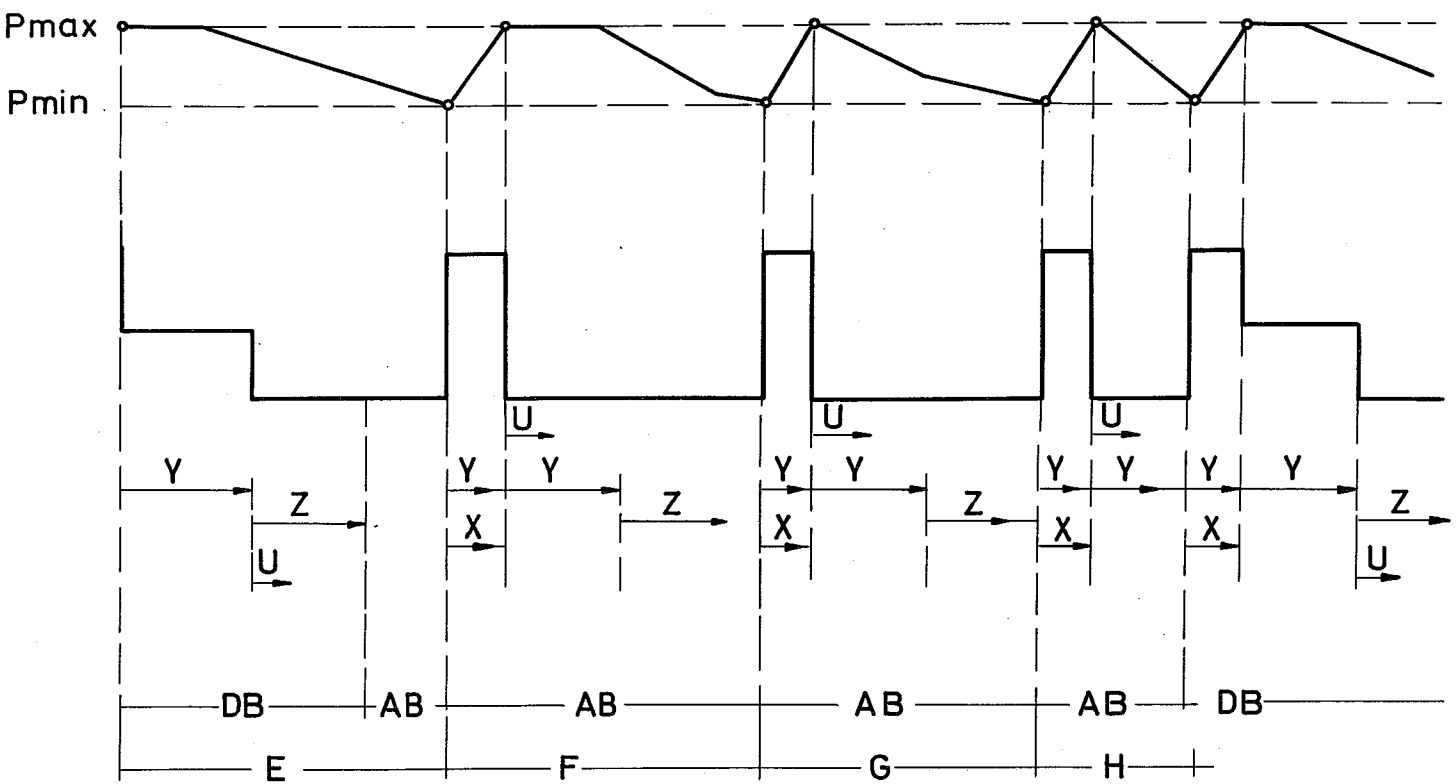
FIG. 2 is a graph which is a continuation of FIG. 1.

FIGS. 1 and 2 show diagrammatic plottings of time versus, respectively from top to bottom, (1) the pressure distribution of the compressor unit, (2) whether the compressor is operating, not operating, or operating at reduced power, and (3) the successive time intervals, Y, Z, X, U and R. The operating sequence is subdivided into various operation periods A, B . . . H to simplify the description of operating mode selection.

A fully automatic working electronic mode selection switch 15 operating in accordance with the invention determines, in dependence upon existing operating conditions, the optimum mode of operation for the compressor unit 13. The compressor unit 13 can be operated in continuous mode (DB), intermittent mode (AB), or regulated mode (RB). During continuous operating mode, the compressor unit 13 is usually running and the throttle flap or valve 7 is opened or closed such that the compressor unit operates with zero load or full load, respectively. During intermittent operating mode, the compressor unit 13 is turned off in response to the pressure switch 5 opening to indicate that a maximum operating pressure has been reached and is turned on again in response to the pressure switch 5 closing to indicate that a operating pressure has been reached. During regulated operating mode, the throttle flap position is infinitely varied between open and closed position in proportion to actual existing compressed air requirements. The regulated operating mode corresponds essentially to the continuous operating mode, but provides for intermediate positions of the throttle flap.

The mode selection switch 15 according to the invention is designed so that switching on of a main control system switch and of a compressor power switch 16 causes the unit to start in the continuous operating mode. During operation of the compressor unit 13, a pressure switch 5 on the pressure side of the compressor unit 13 measures the operating pressure. A switching operation is initiated within the pressure switch 5 in response to a preselected maximum or minimum pressure being reached. The pressure switch 5 may be connected to the pressure connection of the compressor unit or to an optical compressed air receiver 14. Switching points of the pressure switch 5 occur whenever a minimum pressure (switch closes) or a maximum pressure (switch opens) is reached. When the pressure switch 5 closes to indicate a minimum pressure condition ($P_{min}$ status) or opens to indicate a maximum pressure condition ($P_{max}$ status), a signal is generated to initiate the first time step or interval Y.

A second time interval Z is initiated after expiration or completion of first time interval Y. The compressor unit remains in the continuous operating mode or changes over to intermittent operating mode depending upon the existing air requirements during time interval Z. In other words, the length or duration of the switching cycles of the pressure switch 5 determines the next operating mode.

A third time interval X, which is initiated simultaneously with first time interval Y, but only by the signal caused by a minimum pressure condition, can be used to switch the compressor unit over to the regulated operating mode whenever a maximum pressure condition is reached before time interval X has expired.

A fourth time interval U, which is shorter than time interval Z, is initiated whenever the compressor unit is turned off. As shown in FIGS. 1 and 2, initiation of time interval U occurs during continuous mode simultaneously with the initiation of time interval Z when the pressure switch 5 indicates a $P_{max}$ status. Time interval U is also initiated during intermittent mode simultaneous with the initiation of time interval Y when the pressure switch 5 indicates a $P_{max}$ status. In a screw-type compressor operating with oil injection, time interval U provides a period during which the compressor is disabled to prevent turning on of the compressor unit immediately after turning off thereby preventing starting against pressure.

A fifth time interval R is initiated in response to the regulated operation being initiated. After expiration of time interval R, the compressor unit 13 is returned to continuous operating mode, or a renewed checking is made after expiration of time interval R to determine whether the regulated mode of operation should still be retained or operation should be switched over to another mode. Herein, the mode selection switch 15 is preferably designed so that after expiration of time interval R, in the absence of special conditions, operation is switched to continuous mode. Third time interval X is selected to be smaller or shorter than first time interval Y, but time interval R provided for the regulated mode of operation is suitably selected to be smaller than the sum of the first and second time intervals Y and Z.

The time intervals Y and Z suitably are variable or adjustable by means of control knobs or buttons (not shown) while the remaining time intervals X, U and R may be permanently set or adjusted in accordance with the operation characteristics of the respective compressor unit.

Figure 3:
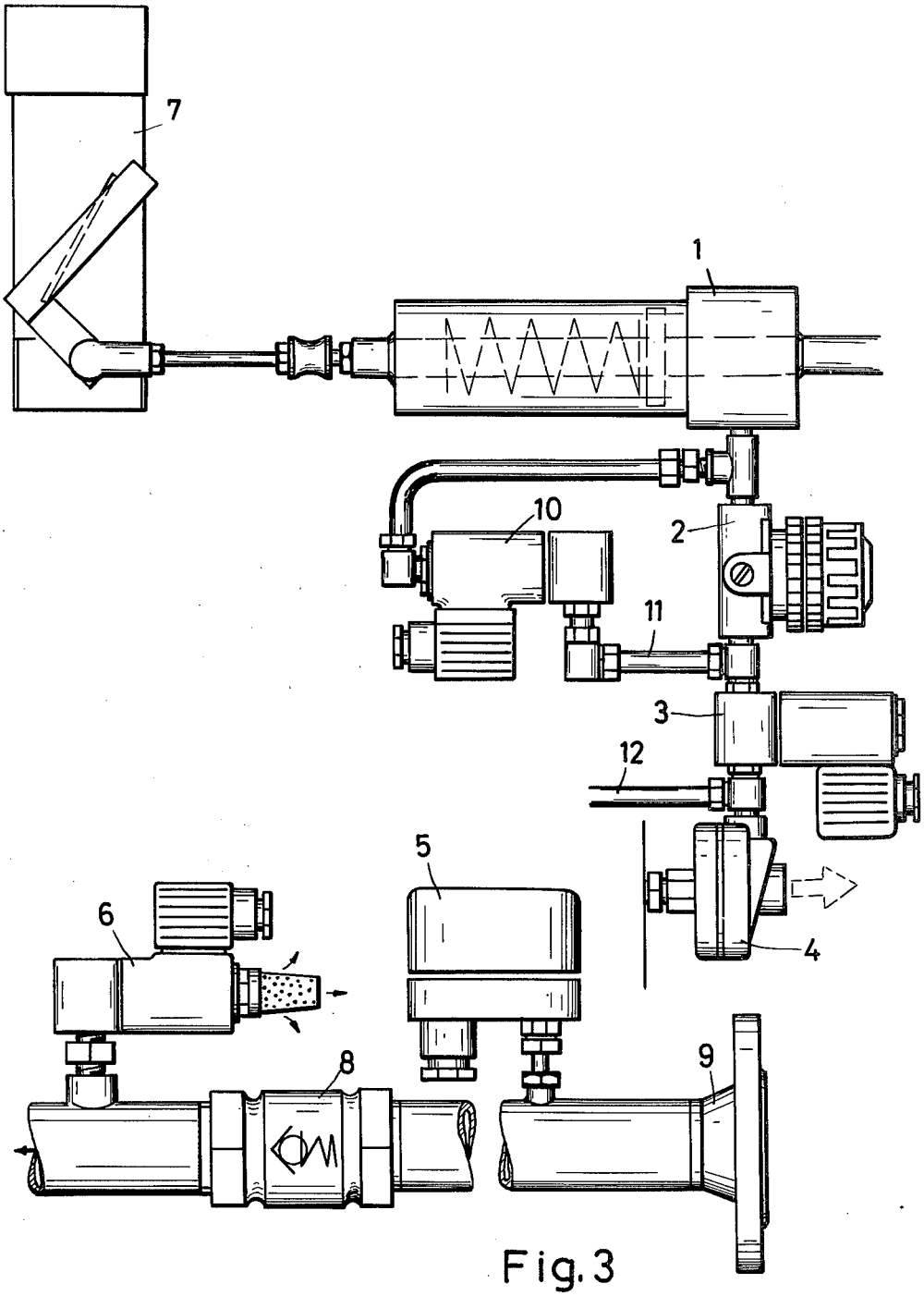
FIG. 3 shows schematically the arrangement of the control valves employed to achieve mode selection.

FIGS. 3 and 5 show schematically the relationship of the mechanical parts of the system which controls the operation of a screw-type compressor unit. A throttle valve or flap 7 is disposed within the intake or suction port of the compressor unit 13. The throttle flap 7 is connected to an operating or adjusting cylinder 1 which operates the throttle flap 7 so that it can be infinitely varied between open and closed positions. A proportioning control valve 2 is connected to adjusting cylinder 1 downstream of a solenoid valve 3 which is disposed in the control line. A further solenoid valve 10 is provided along a line 11 which bypasses the proportioning control valve 2. An exhaust valve 4 is connected directly to the compressor discharge ports upstream of the solenoid valve 3. In a screw compressor of the type having a check or nonreturn valve, the exhaust valve 4 is connected to the compression space or chamber at a point upstream of the nonreturn valve. The line 12 communicates with an optional oil reservoir and/or a compressed air receiver 14 which is under pressure of the compressed air delivered by the compressor unit 13.

A further check or nonreturn valve 8 is disposed at a point downstream of the aforesaid check valve in the pressure line leading from the oil reservoir or compressed air receiver 14 and upstream of a pressure switch 5 which, in the illustrative embodiment shown, is connected to a compressed air withdrawing or outlet connection 9. This pressure switch 5 may optionally be connected to the compressed air receiver 14. A further solenoid valve 6 is connected to the pressure line at a point upstream of the check valve 8.

During continuous mode operation, the volume flow rate of the compressor unit is controlled by the mode selection switch 15, so that only zero and maximum delivery are possible. This may be effected through the use of flaps, grippers for valves or sliders as well as through the use of clutches for the motor. Whether the compressor unit is operated under zero load or full load, the compressor motor 17 is operated during the continuous mode of operation to drive the compressor unit. Preferably, the motor 17 is additionally deloaded (has load removed therefrom) during idling. This can be achieved, for example, by lowering the pressure at the pressure side of the compressor, or by reducing the motor speed through clutches or the like. After expiration of time interval Y during idling or deloaded idling, the driving motor may be switched off with a view to further save power. In the continuous mode of operation, the adjusting cylinder 1 is actuated such that the throttle valve 7 is either moved to closed position or to open position. To close the throttle valve 7, solenoid valves 3 and 10 are opened so that the full pressure from the control line 12 is applied to the adjusting cylinder 1. When pressure is lowered or removed from the adjusting cylinder 1, the throttle flap 7 is moved to an open position by the compression spring provided in the adjusting cylinder 1. For additional deloading during idling, the solenoid valve 6 is opened so that pressure in the pressure line upstream of the check valve 8 is reduced from, for example, 7 bars to 3 bars.

When the compressor unit is turned off, pressure within the compression chamber is removed so that the exhaust valve 4, which is in communication with the compression chamber, opens and vents the control line 12 leading to the oil reservoir or receiver 14. Consequently, the pressure applied to the oil reservoir or receiver 14 is also removed. Thereafter, the compressor unit is ready again to start.

In the intermittent mode of operation, the delivery rate of the compressor unit is controlled solely by switching the compressor motor 17 on and off. Preferably, the compressed air receiver 14 is utilized and its size determines the maximum frequency of switching. The larger the receiver employed, the more economically the compressor can be operated. In the intermittent mode of operation, the solenoid valve 3 is closed so that the throttle flap 7 remains in an open position. When the compressor is turned off, the control line 12 is vented to the atmosphere via the exhaust valve 4.

In the regulated mode of operation, the delivery rate of the compressor unit is infinitely varied between zero load and full load in proportion to compressed air pressure to accommodate the actual current consumption of compressed air. The operation is substantially the same as the continuous mode of operation, the only difference is that the control device on the suction side, such as the throttle valve 7, can be infinitely varied in position by means of a separate control or regulating circuit. In this mode of operation, the solenoid valve 10 is closed and pressure is applied to the adjusting cylinder 1 through the proportioning control valve 2. In the regulated operating mode, the solenoid valve 6 may be opened in the case of zero delivery to remove load from the compressor.

The electronic circuitry of the mode selection switch 15 may comprise, in a manner known, a slow-acting or time-delay relay or an oscillator with pulse counter. This electronic circuitry receives appropriate switching pulses from the pressure switch 5. Depending upon the selection of the mode of operation, the solenoid valves 3, 6 and 10 as well as the respective switches for switching on and off the compressor motor 17 are actuated.

By suitable application of the modes of continuous operation, intermittent operation and regulated operation, the power requirements for generating compressed air needed can be minimized. In this respect, intermittent operation is the most favorable mode of operation, but it can be employed to only a limited extent because of the usual limited number of switching cycles permitted. With the continuous mode of operation, the number of the switching cycles can be considerably increased. The limitation in this case resides in, or is imposed by, the maximum switching frequency of the control device, e.g., the throttle flap 7. The switching frequency of the throttle flap 7, however, is two to five times greater than that of the compressor motor 17.

In the regulated mode of operation, the compressor unit is independent of the number of switching cycles, since the volume flow rate is infinitely matched. On the other hand, regulated mode operation is the most uneconomical mode of operation, since it introduces high throttling losses. It can be utilized, however, whenever a compressed air receiver is not available, i.e., in cases where the compressor unit supplies compressed air directly to the utilization device, or in the case of movable or mobile compressor installations.

Referring to FIG. 4, the decision process for selecting a proper operating mode can be seen. When compressor operation is defined by the portion of the diagram lying within the dashed area in FIG. 4*a* labeled "CONTINUOUS MODE", the compressor unit will be operating in continuous mode; if defined by the portion lying within the area of FIG. 4*b* labeled "INTERMITTENT MODE", then the compressor unit will be operating in intermittent mode; and if defined by the portion lying within the dashed area in FIG. 4*a* labeled "REGULATED MODE", then the compressor will be operating in regulated mode.

In FIG. 1, the compressor unit starts in the continuous mode of operation. If compressed air requirements or demands are so high that the pressure switch 5 does not reach the upper switching point $P_{max}$ during the entire time interval Y+Z, as in period A in FIG. 1, then the compressor unit continues to operate in the continuous mode. Time interval X, although being initiated at the beginning of the interval, does not effect operation in this particular case.

When the pressure switch 5 reaches the upper switching point $P_{max}$, time interval Y is initiated again. At the same time, the compressor unit is switched to idling (load removed) through actuation of the throttle flap 7, which is then closed. During idling, the compressor unit may be additionally deloaded, as in period B in FIG. 1, as determined by the shape of the switching curve or operating characteristics of the compressor so as to reduce power by approximately one half. If after expiration of time interval Y under this deloaded idling condition, the pressure switch 5 is still open, i.e., a maximum pressure status is still present, then the compressor unit is shut down. After expiration of time interval Y, time intervals Z and U are initiated. During time interval U, the compressor unit is disabled and is prevented from being turned on again. In the case of a screw-type compressor unit with oil injection, the pressure present after switching off due to the pressurized oil is removed during time interval U. In the case of a dry operation-type compressor, time interval U may be omitted. During period B, the pressure switch 5 recloses after the switching point $P_{min}$ is reached, whereupon the compressor unit 13 restarts in the continuous mode and time intervals Y and X are initiated again.

During period C in FIG. 1, an operational situation exists similar to that in the preceding periods A and B, but with somewhat different time relationships. First, in a relatively short period of time, but after expiration of time interval X, maximum pressure is achieved whereby a new switching action is caused to occur in the pressure switch 5, and the compressor unit is switched to deloaded idling. Time interval Y is again initiated. After a short idling period, the lower switching point $P_{min}$ is attained so that the compressor unit is switched again to full load, whereby time intervals Y and X are initiated. This sequence of events is repeated until, after a longer period of idling, the compressor unit is switched off with expiration of time interval Y and is switched on again shortly afterwards, but before expiration of time interval Z.

At the beginning of period D, the compressor unit is switched on when a $P_{min}$ condition has been reached whereby the time intervals Y and X are initiated by the closing of pressure switch 5. Before expiration of time interval X, the switching point $P_{max}$ is reached so that the pressure switch 5 opens. This occurrence causes the compressor unit to operate in the regulated mode whereby intake roughly matches the current compressed air requirements by infinitely varying the throttle flap position. While the regulated mode of operation could be interrupted by a signal produced, for example, by the pressure switch 5 being open or closed over a longer period of time, the regulated mode of operation preferably continues for a predetermined time interval R which is initiated upon initiation of the regulated mode of operation. After expiration of time interval R, the regulated mode of operation is automatically turned off. The compressor unit then continues to operate in the continuous mode during period D. If switching point $P_{min}$ is reached during the regulated mode of operation, operation of the compressor unit is switched to continuous mode and time intervals Y and X are initiated again. If the switching point $P_{max}$ is attained thereafter within the time interval X, then the operation is switched again to the regulated mode.

At the beginning of period E in FIG. 2, no compressed air is required so that when maximum pressure is achieved, the pressure switch 5 opens and the time interval Y is initiated. After expiration of time interval Y with the pressure switch 5 still open to indicate a $P_{max}$ status, the compressor unit is switched from deloaded idling to off. Following expiration of time interval Y, time intervals Z and U are initiated. If there is still no demand for compressed air after expiration of interval Z with the pressure switch 5 still open to indicate a $P_{max}$ status, then the compressor unit is switched to the intermittent mode of operation. Accordingly, if during a period longer than the time interval Y+Z the switching point $P_{min}$ is not reached, i.e., the pressure switch 5 is open in the continuous mode of operation for a period longer than the combined time Y+Z, operation of the compressor unit is automatically switched to the intermittent mode as shown in period E.

At the beginning of period F, the pressure switch 5 recloses since the lower switching point $P_{min}$ was reached. The compressor unit operating in the intermittent mode is turned on and runs until the pressure switch 5 is reopened in response to the maximum pressure being reached whereupon the compressor unit is turned off, and time interval Y is initiated. When the compressor unit is operated in the intermittent mode as in period F, turning off of the compressor unit initiates time intervals Y and U. After the compressor unit is turned off, it can only be restarted after time interval U expires so that operation of the compressor unit against pressure immediately thereafter is prevented. During period F, minimum pressure is reached only after expiration of time Y+Z so that the compressor unit continues in the intermittent mode and restarts again.

Period G illustrates the operation of the compressor unit in the intermittent mode of operation similar to that during the preceding period F. However, there are different time relationships. During period G, minimum pressure is reached within time interval Z, whereupon the compressor restarts and remains in the intermittent mode of operation. If the pressure switch is closed to indicate a $P_{min}$ status for a period longer than the overall time Y+Z, i.e., if the pressure switch 5 indicates a minimum pressure condition for a period longer than this overall time, then operation of the compressor unit is switched to continuous mode.

As illustrated in FIG. 2 during period H, it may happen that after changing over from the continuous mode to the intermittent mode of operation, the minimum pressure condition is reached so shortly after the immediately preceding switch on cycle that the maximum switching frequency of the unit per hour is exceeded. If during operation in the intermittent mode after the last switching off of the compressor unit and the simultaneous beginning of time interval Y, the lower switching point $P_{min}$ of the pressure switch 5 is reached before expiration of time interval Y, the compressor unit is returned to continuous mode of operation. This is shown in period H.

There are two conditions when the compressor unit may be switched from the intermittent mode to the continuous mode of operation: (a) when within time interval, Y, a $P_{max}$ condition is followed by a $P_{min}$ condition, as in the case of period H, and (b) when during the whole time interval Y+Z, a $P_{min}$ condition exists, i.e., a maximum pressure condition is not reached. The compressor unit may be switched over from intermittent mode to regulated mode of operation when a maximum pressure condition is reached within time interval X, which is initiated in response to a switching on action. The compressor unit remains in intermittent operating mode when during the time interval Y, a $P_{max}$ status is indicated by the pressure switch 5.

The compressor normally runs in continuous operating mode except where (a) a $P_{max}$ condition exists for an interval greater than Y+Z to cause intermittent operation, or (b) a $P_{max}$ condition occurs within time interval X to cause regulated operation.

In a practical embodiment, such as a screw-type compressor, the first time interval Y may be set between 1.5 and 35 minutes. Time interval Y should be selected so that during the intermittent mode of operation, the maximum permissible switch on frequency of the compressor unit is not exceeded. Otherwise, operation will be switched to continuous mode.

The time interval Z can likewise be set between 1.5 and 35 minutes. Along with time interval Y, it is time interval Z that essentially determines switch over from continuous mode to intermittent mode of operation when the pressure switch 5 is open for a period longer than the overall time interval Y+Z, or switch over from the intermittent mode to the continuous mode of operation when the pressure switch 5 is closed for a period of time longer than the overall time interval Y+Z. The time interval Z is always initiated by the expiration of time interval Y and is ended by each renewed beginning of time interval Y.

The time interval U is set between 10 and 30 seconds. This time is initiated always by a signal indicating that the compressor unit has been turned off and prevents the compressor from restarting against pressure. Time interval U is provided in the case of a screw-type compressor with oil injection so that, after turning off of the compressor unit, the pressure created as a result of the oil injection, which is under the pressure of the compressed air, can be removed during time interval U. After removal of this pressure the compressor unit then can be turned on again.

The time interval X should not be set to more than 2 minutes. Time interval X normally is initiated only in the continuous mode of operation by a signal from the pressure switch indicating a $P_{min}$ condition. The mode selection switch 15 may be arranged so that the compressor switches over to the regulated mode of operation whenever a signal indicating that a $P_{min}$ condition has been reached is followed within a time interval X by a signal indicating that a $P_{max}$ condition has been reached, or when two or more such signals occur within time interval X.

The time interval R provided for the regulated mode of operation can be set between 5 and 15 minutes. Time interval R commences with initiation of the regulated mode of operation. After expiration of time interval R, the compressor unit is automatically switched back to continuous mode operation so that operating conditions can be checked again and the most advantageous or optimal mode of operation can be selected.

The mode selection switch 5 constructed in accordance with the invention satisfies the operational requirements for compressors having different applications. In addition to economical operation with respect of energy or power requirements, the method also operates to reduce wear and protects the compressor unit from excessive use.

Various modifications are feasible within the scope of the invention. Thus, for example, the mode selection switch 15 may be designed so that operation is not switched over to the regulated mode until a plurality of switching pulses are received from the pressure switch 5 within a given period of time. Likewise, it would be possible to interrupt the regulated mode of operation for a renewed checking of the operating conditions if the maximum or minimum pressure is present for a predetermined period of time during the regulated operation.

Similarly, a multiple-stage pressure switch or a plurality of respectively differently set pressure switches may be utilized to supply switching pulses at predetermined pressure stages or values between or intermediate the minimum and maximum pressures so that a decision as to the mode of operation could be made on the basis of the pressure distribution between the limit values. Such an embodiment of the invention could obviously be combined with the previously described embodiment.

Time interval X, provided to determine the operating conditions for the regulated mode of operation, may be initiated both at the lower switching point $P_{min}$ and at the upper switching point $P_{max}$. Depending upon the type of compressor used, the previously noted times may be selected to have differing lengths in accordance with the actual existing conditions. Thus, for example, time interval Y may be initiated following time interval X, and time interval Z can be initiated following time interval U. By providing a series of respective shorter time steps or intervals, the operating conditions could be determined more precisely with appropriately accommodating or matching the mode of operation.

In the arrangement of the valves for effecting the mode of operation control, the solenoid valve 3 can be disposed in the bypass line 11 in advance of the solenoid valve 10 so that its respective command is suppressed.

Further, time interval X, which serves to determine or detect the conditions for the regulated mode of operation, can be initiated in the continuous mode of operation both at switching point $P_{min}$ and at switching point $P_{max}$, if desired, while in the other modes of operation time interval X is initiated only at switching point $P_{min}$.

I claim:

1. A method for automatically controlling the operation of a compressor or the like in response to the demand for the output of the compressor, the compressor having control means for varying the compressor intake between open and closed conditions and drive means for operating the compressor or terminating operation thereof, the method comprising:

measuring the pressure maintained by the compressor;

normally operating the compressor in continuous mode in which the drive means is operative to run the compressor with the control means moving the compressor intake only to a fully opened condition after a preselected minimum pressure is reached or to a fully closed condition after a preselected maximum pressure is reached;

initiating time measurement when the minimum pressure is reached or the maximum pressure is reached; and changing operation of the compressor from continuous mode to intermittent mode in which the drive means is operative to run the compressor after the minimum pressure is reached and stop the compressor after the maximum pressure is reached when the time interval between the time when the pressure reaches the maximum and the time when the pressure reaches the minimum exceeds a preselected time.

2. A method for automatically controlling the operation of a compressor or the like in response to the demand for the output of the compressor, the compressor having control means for varying the compressor intake between open and closed conditions and drive means for operating the compressor or terminating operation thereof, the method comprising:

measuring the pressure maintained by the compressor;

normally operating the compressor in continuous mode in which the drive means is operative to run the compressor with the control means moving the compressor intake only to a fully opened condition after a preselected minimum pressure is reached or to a fully closed condition after a preselected maximum pressure is reached;

initiating time measurement when the minimum pressure is reached or the maximum pressure is reached; and changing the operation of the compressor to regulated mode in which the drive means for a predetermined time is operative to run the compressor with the control means varying the compressor intake in proportion to the pressure maintained by the compressor for a period of time when the time interval between the time when the pressure reaches the minimum and the time when the pressure reaches the maximum is within a preselected time.

3. A method for automatically controlling the operation of a compressor or the like in response to the demand for the output of the compressor, the compressor having control means for varying the compressor intake between open and closed conditions and drive means for operating the compressor or terminating operation thereof, the method comprising:

measuring the pressure maintained by the compressor;

normally operating the compressor in continuous mode in which the drive means is operative to run the compressor with the control means moving the compressor intake to a fully opened condition after a preselected minimum pressure is reached or to a fully closed condition after a preselected maximum pressure is reached;

initiating time measurement when the minimum pressure is reached or the maximum pressure is reached; and changing operation of the compressor from continuous mode to intermittent mode in which the drive means is operative to run the compressor after the minimum pressure is reached and stop the compressor after the maximum pressure is reached when the time interval between the time when the pressure reaches the maximum and the time when the pressure reaches the minimum exceeds a first preselected time; and maintaining operation of the compressor in the intermittent mode so long as the time interval between the time when the pressure reaches the maximum and the time when the pressure reaches a minimum exceeds a second preselected time.

4. The method of claim 3 wherein a time interval Y is initiated when the pressure reaches the minimum or the maximum and a time interval Z is initiated after said time interval Y expires, said first preselected time being equal to the time interval Y+Z and said second preselected time being equal to the time interval Y, where the time intervals Y and Z are predetermined.

5. The method of claim 3 wherein the compressor is operated in said continuous mode when the compressor is initially started.

6. The method of claim 3 wherein operation of the compressor is maintained in continuous mode when the time interval between the time when the pressure reaches a maximum and the time the pressure reaches a minimum is within said first preselected time.

7. The method of claim 6 wherein a time interval Y is initiated when the pressure reaches the minimum or the maximum and a time interval Z is initiated after said time interval Y expires, said first preselected time being equal to the time interval Y+Z and said second preselected time being equal to the time interval Y, where the time intervals Y and Z are predetermined.

8. The method of claim 7 wherein a time interval X is initiated when said time interval Y is initiated, said time interval X being less than said time interval Y, and said third preselected time interval being equal to said time interval X.

9. The method of claim 8 wherein said time interval X is initiated with said time interval Y only after the pressure reaches the minimum.

10. The method of claim 6 wherein the drive means runs the compressor at reduced power when the compressor is operated in said continuous mode after the pressure reaches the maximum.

11. The method of claim 7 wherein the drive means stops the compressor during continuous operating mode after the pressure reaches a maximum and said interval Y has expired.

12. The method of claim 3 wherein the operation of the compressor is changed to regulated mode in which the drive means for a predetermined time is operative to run the compressor with the control means varying the compressor intake in proportion to the pressure maintained by the compressor for a period of time when the time interval between the time when the pressure reaches the minimum and the time when the pressure reaches the maximum is within a preselected time.

13. The method of claim 12 wherein the compressor is operated in said continuous mode after it has operated in said regulated mode for a period of time.

14. The method of claim 12 wherein a time interval R is initiated when compressor operation is changed to said regulated mode, and said compressor is operated in continuous mode after expiration of time interval R.

15. The method of claim 14 wherein the compressor is returned to continuous mode operation when the pressure reaches the minimum during said time interval R.

16. The method of claim 3 wherein a time interval U is initiated when compressor operation is terminated, said compressor being rendered inoperative until said time interval U expires.

17. The method of claim 16 wherein said time interval U is less than said first preselected time.

18. An apparatus for automatically controlling the operation of a compressor or the like in response to the demand for the output of the compressor comprising:

control means responsive to applied pressure for adjusting the intake volume of the compressor;

conduit means for providing communication between the discharge port of the compressor and said control means of fluid under pressure;

valve means disposed along said conduit means for supervising the flow of fluid under pressure from the compressor discharge port through said conduit means;

first switch means for turning the compressor on and off;

pressure switch means for measuring the pressure maintained by the compressor and generating a first signal when a minimum pressure condition is measured and a second signal when a maximum pressure condition is measured;

timing means responsive to said pressure switch means for measuring the passage of time, said timing means initiating a first time interval whenever the signal from said pressure switch means is changed and initiating a second time interval whenever said first time interval expires; and second switch means responsive to signals from said pressure switch means and said timing means to select the mode of operation of the compressor by operating said first switch means and said valve means, said second switch means adapted to select a continuous mode, an intermittent mode or a rgulated mode of operation.

19. The apparatus o claim 18 wherein said second switch means includes mean for preventing restarting of the compressor for a preselected period of time after the compressor has been turned off.

20. The apparatus of claim 18 wherein said valve means includes first valve means along said conduit means, regulating valve means along said conduit means downstream of said first valve means, and second valve means along a bypass line connected upstream and downstream of said regulating valve means, said first and second valve means being controlled by said second switch means.

21. The apparatus of claim 20 wherein said second switch means includes means for causing said first valve means to close during continuous operating mode when said first signal is present to prevent fluid under pressure from acting on said control means, said control means opening the compressor intake in the absence of pressure.

22. The apparatus of claim 21 wherein said second switch means includes means for causing said first and second valve means to open during continuous mode operation when said signal is present to permit fluid under pressure to act on said control means, said control means being adapted to close the compressor intake in the presence of pressure.

23. The apparatus of claim 22 wherein said second switch means includes means for operating said first switch means to turn off the compressor during continuous mode operation when said second signal is present for a period greater than said first and second time intervals together.

24. The apparatus of claim 20 wherein said second switch means includes means for changing the operation of the compressor from continuous mode to intermittent mode when said second signal is present for a period greater than said first and second time intervals together and means for operating said first switch means to turn on the compressor whenever said first signal is present and for operating said first switch means to turn off the compressor whenever said second signal is present.

25. The apparatus of claim 24 wherein said second switch means includes means for changing the operation of the compressor from intermittent mode to continuous mode when said first signal is present for a period greater than said first and second time intervals together or when said second signal is present for a period less than said first time interval.

26. The apparatus of claim 20 wherein said second switch means includes means for causing said first valve means to open and said second valve means to close when the time period between said first signal and said second signal from said pressure switch means is less than a preselected amount whereby the compressor intake volume is controlled by said regulating valve means in proportion to the output pressure maintained by the compressor.

* * * * *